United States Patent [19]

Masuda

[11] Patent Number: 5,053,742

[45] Date of Patent: Oct. 1, 1991

[54] VARIABLE RESISTOR

[75] Inventor: Fumitoshi Masuda, Nagaokakyo, Japan

[73] Assignee: Murata Manufacturing Co., Ltd., Kyoto, Japan

[21] Appl. No.: 431,039

[22] Filed: Nov. 3, 1989

[30] Foreign Application Priority Data

| | | | |
|---|---|---|---|
| Nov. 5, 1988 | [JP] | Japan | 63-279904 |
| Nov. 5, 1988 | [JP] | Japan | 63-279905 |
| Nov. 5, 1988 | [JP] | Japan | 63-279906 |
| Nov. 5, 1988 | [JP] | Japan | 63-279908 |
| Nov. 5, 1988 | [JP] | Japan | 63-279909 |

[51] Int. Cl.[5] ..... H01C 10/32

[52] U.S. Cl. ..... 338/162; 338/163; 338/164; 338/167; 338/171

[58] Field of Search ..... 338/162, 163, 164, 167, 338/170, 171

[56] References Cited

U.S. PATENT DOCUMENTS 3,484,734 12/1969 Casey et al. ..... 338/162

3,537,056 10/1970 Van Benthuysen et al. ..... 338/162

*Primary Examiner*—Marvin M. Lateef

*Attorney, Agent, or Firm*—Wenderoth, Lind & Ponack

[57] ABSTRACT

A variable resistor having an insulating substate provided on the surface thereof with a resistor is molded into a resin case, a part of which is heated and bent to rotatably secure a rotor having a sliding member within the case for rotation with respect to the insulating substrate. The insulating substrate is molded into the resin case to make inside of the case airtight. An annular elastic body mounted between the under surface of a skirt portion of the rotor and the insulating substrate makes the space between the rotor and the insulating substrate airtight, and, at the same time, sets the rotational torque of the rotor to a suitable value. The arrangement of the insulating substrate, the resin case and the rotor having the sliding member, reduces the number of parts used for assembling the variable resistor, and together with the use of continuous strip hoop materials for forming terminals and the sliding member, allows for continuous automated production of the variable resistors.

14 Claims, 9 Drawing Sheets

VARIABLE RESISTOR

BACKGROUND OF THE INVENTION

The present invention relates to a structure of a variable resistor in which a rotor with a sliding member is rotatably fixed with respect to a substrate provided with a resistor on the surface thereof.

The variable resistor shown in FIGS. 23 and 24 has been known as an electronic component in which a rotor, a stator and the like are incorporated.

In this variable resistor, reference numeral 150 designates the insulating substrate, and the resistor 151 and the collector electrode 152 are provided on the surface thereof. Reference numerals 161, 162 and 163 designate lead terminals; the terminal 161 is electrically connected to one end of the resistor 151, the terminal 162 to the other end thereof, and the terminal 163 to the collector electrode 152, respectively.

The brush-shaped sliding member 165 is fixed at the substrate portion thereof to the concave recess 170*c* provided at the under surface of the rotor 170, and moves slidably on the resistor 151 and the collector electrode 152. The drive-engaging groove 170*b* is formed at the projection 170*a* of the rotor 170.

The case 180, through the O-ring 190, rotatably mounts the rotor 170 on the substrate 150. The member 165 is secured to the rotor 170, and the case 180 has an opening 180*a* at its upper surface exposing to the outside the convex projection 170*a* of the rotor 170. The O-ring 190 is formed of a seal resin which is made of thermosetting epoxy resin or the like and is obtained through potting and curing thereof to keep the inside of the case airtight and at the same time to retain the rotor 170 within the case 180. The O-ring also functions to secure the substrate 150 to the case 180.

In this variable resistor when the rotor 170 is rotated with respect to the substrate 150 and the case 180 using its driver-engaging groove 170*b*, the sliding member 165 slides on the resistor 151 and the collector electrode 152 with the result that the resistance value between the terminals 162 and 161 or 163 is adjusted.

But, in such a variable resistor as above-described, various problems have been caused, including difficult assembly, by employing the large number of parts such as substrate 150, sliding member 165, rotor 170, case 180 and the like. Also, the growing need for accuracy in mutually positioning components for automatic assembling results in reduced productivity efficiency when a large number of parts must be assembled.

In addition, potting is required for the seal resin 190 in securing the substrate 150 to the case 180, which has been a barrier to automatic assembling of the components due to difficult adjustment of the injection amount of the seal resin. Moreover, it takes substantial time to cure the seal resin 190 and such curing necessitates additional manufacturing equipment. In the seal-type structure case, heat applied to cure the seal resin causes inner pressure to go up within the case, thereby forcing open a hole in the seal resin 190. Accordingly, productivity has not been improved.

Also, in the conventional variable resistor above-described, there are two ways of mounting on the printed substrate, regular 2.5 mm pitch and irregular 2.5 mm pitch, the intervals among the terminals 161, 162 and 163 being different according to the type of mounting. Differences in intervals cause different types of components to be produced with the result that the same shaped dies can not be used for manufacturing the case, the substrate and the terminals. Moreover, as shown in FIGS. 23 and 24, the terminals are projected in two ways; one is from the side of the case 180 and the other from the bottom thereof. Accordingly, it is necessary in the production line to take into consideration the above-described two types of terminal pitches and combinations therewith of different projection directions, thus resulting in complicated control of stored parts and products.

A sliding member is shown in FIG. 25 as one example of use of a conventional variable resistor in which the arm 193 with a cut 192 therein is formed at the periphery of the disk-shaped substrate portion 191. The arm is bent at both ends 193*b*, 193*b* thereof with its central part projecting horizontally to define contact portions 193*b*, 193*b*. The cut 192 divides contact portions 193*b*, 193*b* into two to heighten contact reliability.

But, as shown in FIG. 26, with this sliding member, when the contact portions 193*b*, 193*b* are out of contact with the resistor they are in the position shown in a solid line, while when forced to contact it they come to the position shown in a chain line.

In other words, depending on conditions, the contact portions 193*b*, 193*b* of this sliding member shift in the radial direction of the sliding member as shown by the arrow D.

The fact that the portions 193*b*, 193*b* are in a radially inwardly shifted position, when out of contact with the resistor relative to when in contact therewith, causes difficulty in molding the sliding member at the rotor. When the sliding member is molded at the rotor, the contact portions 193*b*, 193*b*, out of contact with the resistor, are housed in the space of a metal mold, and the position shifted to the inside requires a thinned portion in the metal mold which is disadvantageous in processing the mold as well as to its useful life.

In addition, this construction poses a problem in that, since the divided contact portions 193*b*, 193*b* are disposed side by side, their movement on the resistor is restricted due to mutual interference thereby, and also miniaturization of the sliding member itself is limited from a constructional viewpoint.

Accordingly, it is proposed that an arm 293 simply be cut at the central part thereof by a straight line M in such a manner as to divide it into two in the peripheral direction and that end portions thus obtained are again bent to define contact portions 293*b*, 293*b* as shown in FIG. 27. In this case, the line M tilts with respect to the line A going through the center of the substrate portion 291. But, another problem is created in that contact portions 293*b*, 293*b* of this sliding member are small in width thereby causing difficulty in processing and miniaturization thereof.

It is also proposed that, as shown in FIG. 28, an arm 393 is cut at the central part thereof with a straight line N to form contact portions 393*b*, 393*b*. The line N in this case intersects the line A at a right angle. While the contact portions 393*b*, 393*b* have larger widths in this sliding member, a gap can not be formed between the contact portions 393*b*, 393*b*, like those in FIG. 25, thus causing mutual interference therebetween.

In addition, both device shown in FIGS. 27 and 28 have the arms bent at bending points 291*a* and 391*a*, respectively, along the lines A′ going through the center of the substrates so that, like those shown in FIG. 25, the contact portions move horizontally to the left when not in contact and to the right when in contact, respectively, with respect to the substrate portions, thereby making molding at the rotor difficult.

SUMMARY OF THE INVENTION

Accordingly, it is a first object of the invention to provide a variable resistor which is easy to manufacture, suitable for automatic assembly, superior in inside airtightness, and excellent in productivity.

It is a second object of the invention to provide a variable resistor in which the sliding member itself can be miniaturized, mutual interference at the contact portions is prevented to reduce noise, and continuous automatic assembly can be provided with the use of continuous strip hoop materials.

It is a third object of the invention to provide a variable resistor for which rotating angles of the rotor can be exactly distinguished at a glance.

It is a fourth object of the invention to provide a variable resistor which has a case, a substrate and terminals in common in spite of differences in pitches or projection directions of the terminals, and can be effectively manufactured on the same production line by simply changing the bending processes for the terminals.

BRIEF DESCRIPTION OF THE DRAWINGS

FIG. 1 is a plan view of the insulating substrate with terminals.

FIG. 2 is a plan view showing terminals before assembly.

FIG. 3 is a plan view, half of which shows a sectional view of the substrate molded in a case.

FIG. 4 is a side elevation of FIG. 3.

FIG. 5 is a sectional view of FIG. 3 taken along the line V-V thereof.

FIG. 6 is a bottom view of FIG. 3.

FIG. 7 is a plan view of the rotor with a sliding member molded therein.

FIG. 8 is a sectional view of FIG. 7 taken along the line VIII-VIII thereof.

FIG. 9 is a bottom view of FIG. 7.

FIGS. 10 and 11 are illustrations showing flexure of contact portions of the sliding member.

FIG. 12 is a semi-plan and semi-sectional view of an assembled variables resistor.

FIG. 13 is a sectional view of FIG. 12 taken along the line XIII-XIII thereof.

FIG. 14 is a bottom view of FIG. 12.

FIG. 15 is a plan view showing a regular pitch of inserting holes provided in the printed substrate.

FIG. 16 is a plan view showing an irregular pitch of inserting holes provided in the printed substrate.

FIG. 17 is a side view of the case showing the projecting positions of the terminals with regular and irregular pitches.

FIG. 18 is a perspective view showing how the terminals are bent.

FIG. 19 is a plan view of a rotor with a sliding member fixed thereto.

FIG. 20 is a sectional view of FIG. 19 taken along the line XX—XX thereof.

FIG. 21 is a bottom view of FIG. 19.

DETAILED DESCRIPTION OF THE INVENTION

Figure 11:
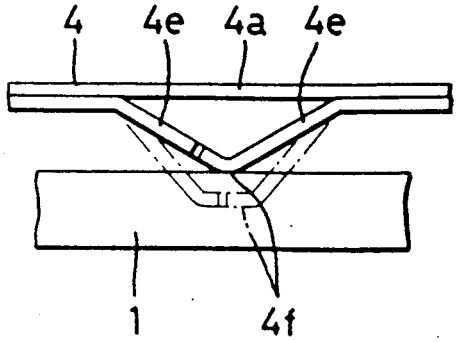
Figure 12:
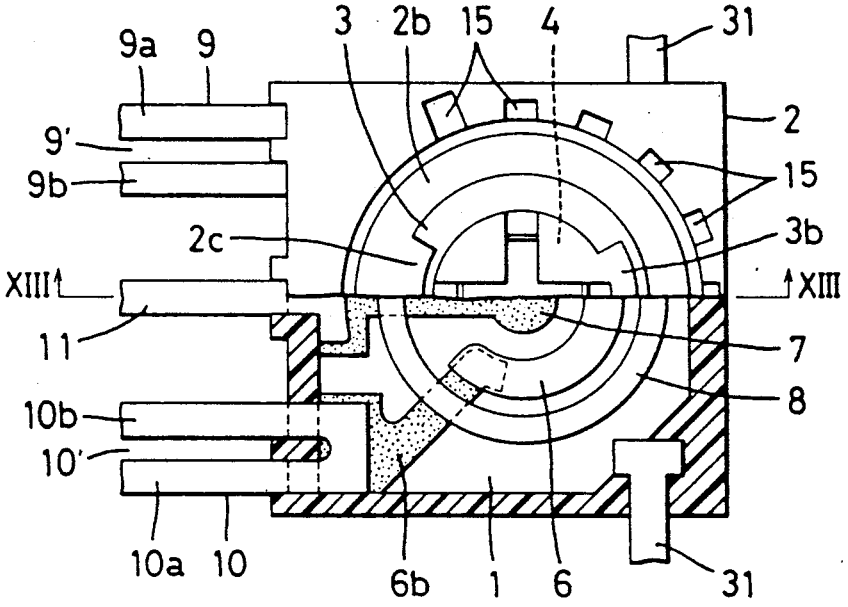
Figure 13:
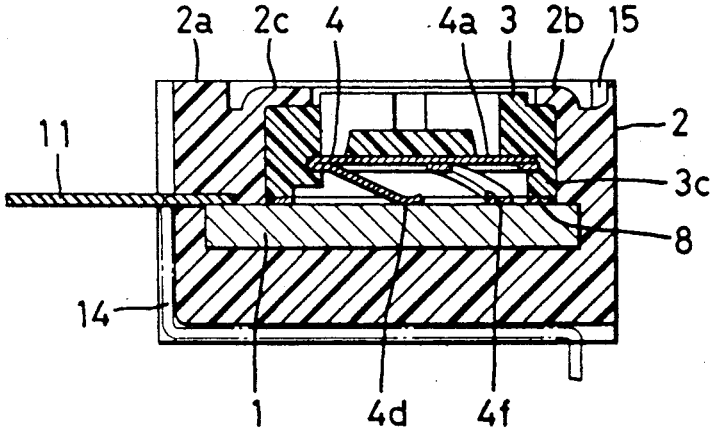

In the first example shown in FIGS. 1 through 18, a variable resistor of the present invention substantially comprises: an insulating substrate 1 having terminals and provided with a resistor 6; a case 2 to which said substrate is fixed; and a rotor 3, provided with a sliding member 4, rotatably retained in said case 2, as shown in FIGS. 12 and 13. Lead terminals 9, 10 and a collector terminal 11 extend out of the case 2. The case 2 is preferably made of resin material.

Figure 1:
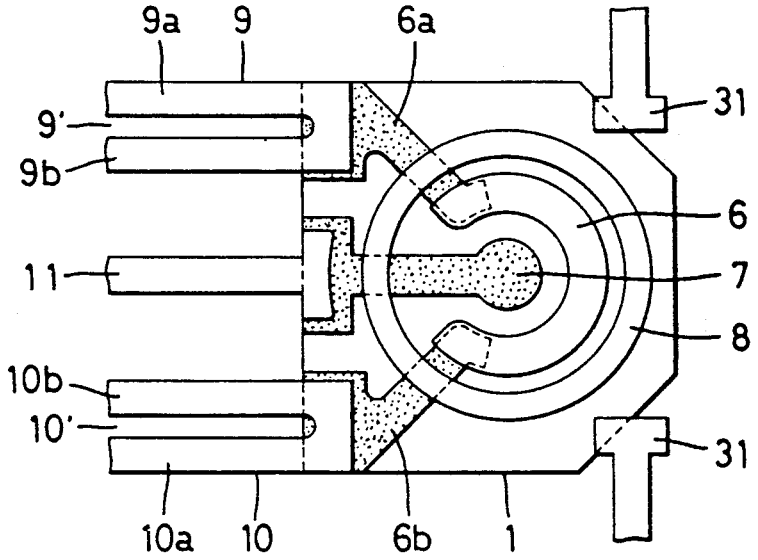
FIGS. 1 through 18 show the first example of the variable resistor of the invention.

As shown in FIG. 1, the substrate 1 has on the surface thereof the resistor 6, electrodes 6*a*, a collector electrode 7 and an elastic body 8. The resistor 6 is horseshoe-shaped and the first lead terminal 9 is soldered thereto through the electrode 6*a* at one end thereof, and the second terminal 10 through the electrode 6*b* at the other end, respective. The collector electrode 7 extends from the central part of the substrate 1 to its one end portion and the collector terminal 11 is connected to the end of the collector electrode 7.

The terminals 9, 10 and 11 are made of copper alloy or the like and are fixed to the electrodes 6*a*, 6*b* and 7 in such a way that solder plating is applied beforehand at least to the end portions of the terminals which are placed on the respective electrodes, and then the plated parts thereof are melted by heating of Joule heat, a heater, or the like so as for the terminals to be soldered to the electrodes. Preferably, alumina is used for the substrate 1, and silver or an alloy of silver-palladium for the electrodes 6*a*, 6*b* and 7.

The elastic body 8 is fixedly secured in an annular way to the substrate 1 surface in a position opposite to the skirt portion 3*c* of the rotor 3 to be described later. Insulating silicon elastomer or the like, that can stand up to not only the soldering temperature but also a solvent for flux cleaning and the like, is used as the material for the elastic body 8. Screen printing, drawing methods, dipping or the like may be adopted for securing the elastic body to the substrate 1. By the use of this elastic body, airtightness is obtained inside the enclosed portion of the space inside the rotor 3 when the elastic body 8 is brought into contact with the rotor 3 and, at the same time a rotating torque is raised thereby, causing stability to be obtained. Also a buffing function is obtained when the substrate 1 and the resin case 2 are molded integrally, so as to prevent cracking of the substrate from occurring. The use of the elastic body also has the advantage of controlling flow of molding resin in the resin case 2 to the above-described resistor 6 side.

Figure 2:
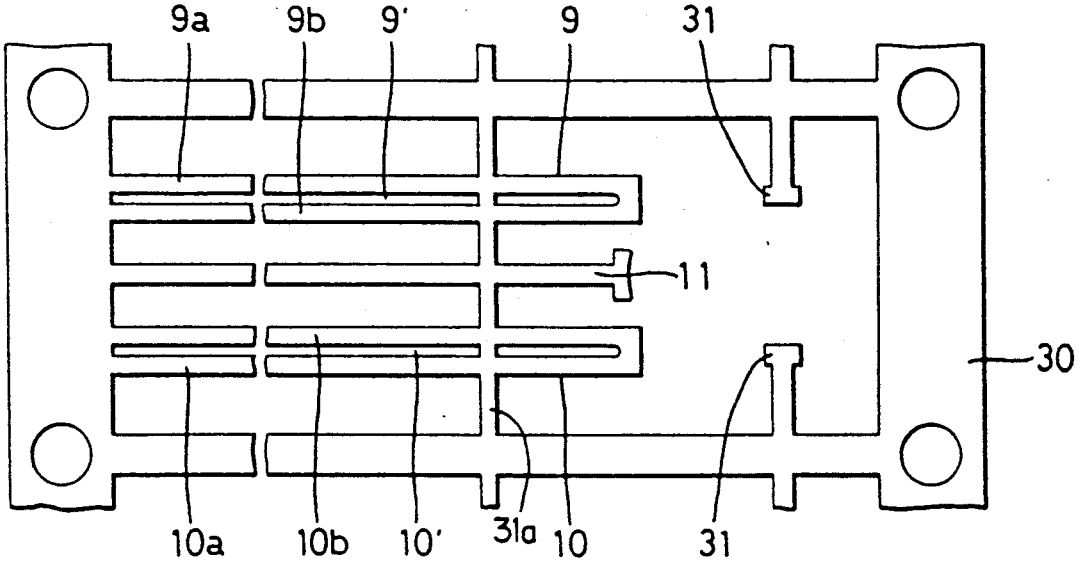
Figure 3:
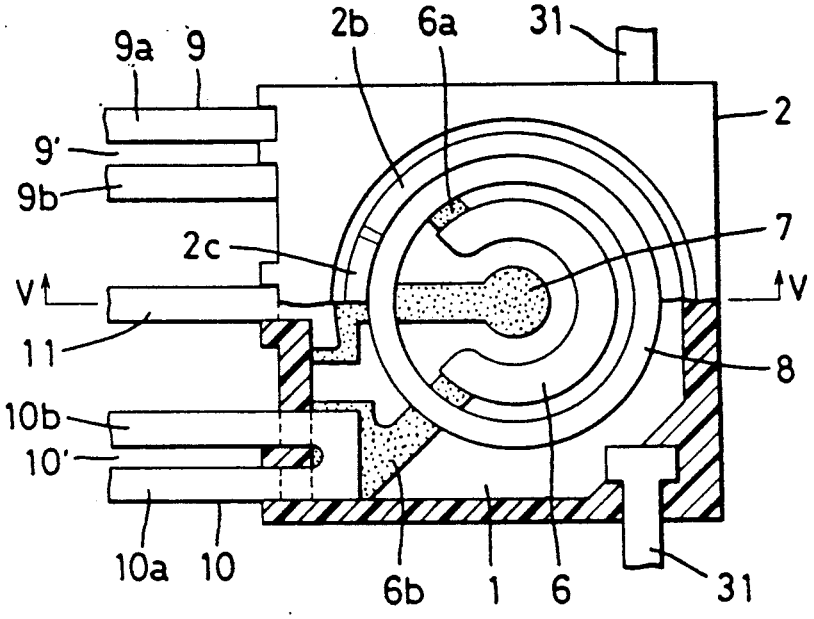
Figure 4:
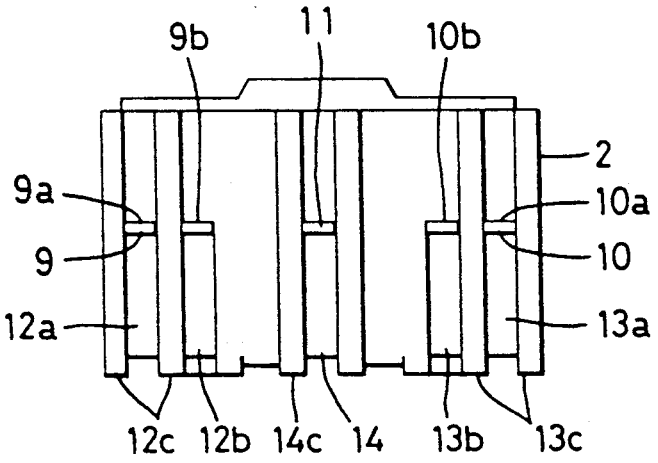
Figure 5:
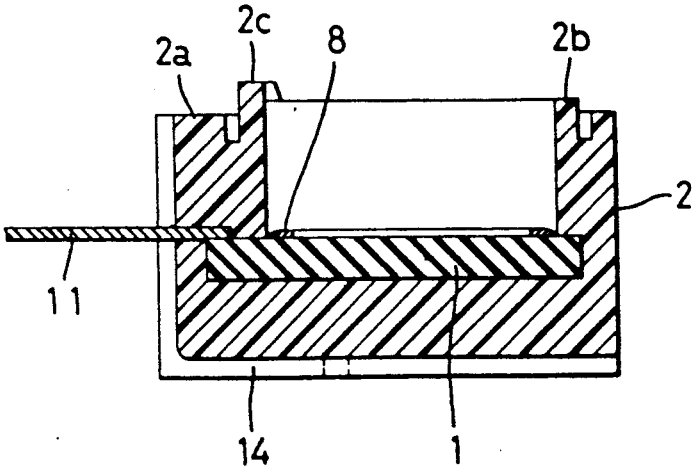
Figure 6:
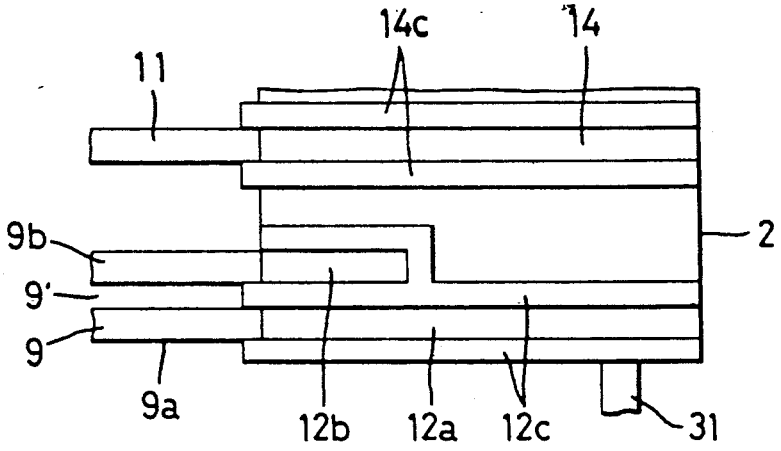

The resin case 2 comprising the substrate 1 is manufactured while being retained by a hoop material 30 shaped as shown in FIG. 2. In other words, the substrate 1 is joined with the resin case 2 while being retained by the soldered terminals 9, 10, 11 and dummy terminals 31, 31 (see FIGS. 3 and 5). Needless to say, the tie bars 31*a* and the dummy terminals 31, 31 of the hoop material 30 are cut off eventually. Slits 9', 10' are formed longitudinally along the lead terminals 9 and 10 to define divided forked tines *9a*, 9*b*, 10*a*, 10*b*, in order to correspond to mounting types having both regular pitch of 2.5 mm and irregular pitch of 2.5 mm, as will be explained later.

The resin case 2 is of cylindrical shape having an opening at its upper surface and is provided with a plurality of grooves 12*a*, 12*b*, 13*a*, 13*b* and 14 from the side to the bottom surface thereof to house the above-described terminals 9, 10, 11 as shown in FIGS. 3 through 6. The tubular portion 2*a* of the resin case 2 has an opening at its upper surface of an inside diameter large enough to rotatably house the rotor 3. At the inner periphery of the above-described tubular portion is formed the ring-shaped projection 2*b* which has a width large enough to allow for bending thereof by heating.

The grooves 12*a*, 12*b*, 13*a*, 13*b* and 14 are formed to suit the width of the lead terminals 9, 10 and collector terminal 11. The grooves 12*a*, 13*a* correspond to the forked terminals 9*a*, 10*a* of the lead terminals 9, 10 and the grooves 12*a*, 13*b* correspond to the forked terminals 9*b*, 10*b*. These grooves extend from the upper surface edge portion of the case 2 to the side and then to the bottom surface side in such a manner as to bend each of the terminals 9, 10, 11 projecting from the side of the case 2 at the required points in order that they can be properly positioned.

The grooves are formed at intervals such that they correspond to a predetermined pitch, that is, the distance between insertion holes for the terminals formed in the printed substrate on which a variable resistor is mounted. The present examples are suitable for both regular and irregular pitches of 2.5 mm as will be described later.

In addition, the edge portions 12*c*, 13*c*, 14*c* are projected outwardly so as to facilitate such fixing processes as heating and the like for the terminals 9, 10, 11, and at the same time, improve stability of the variable resistor when mounted on the printed substrate and provide a standoff function for better soldering.

The resin case 2 described above is preferably made of thermoplastic resin, for example, PBT resin or the like, whose heat deforming temperature is the same as or lower than that of the rotor 3.

Figure 7:
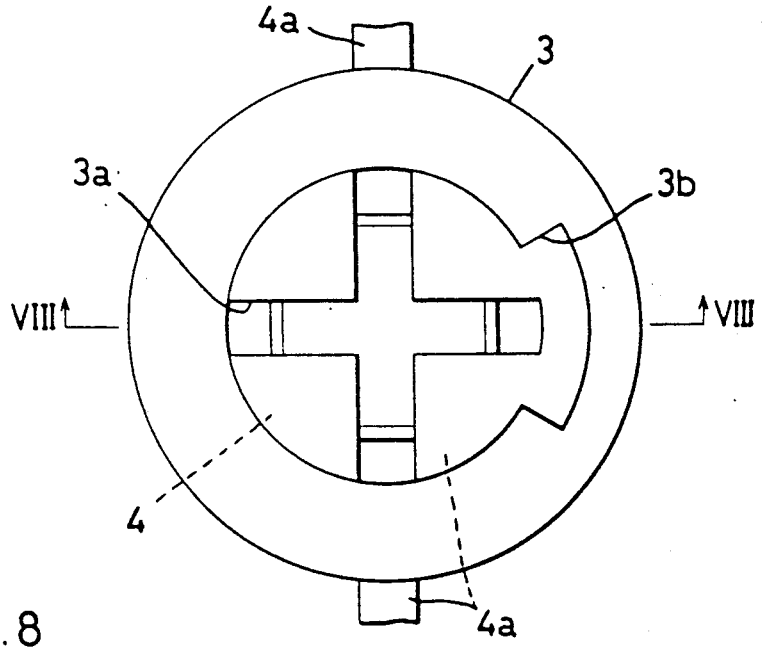
Figure 8:
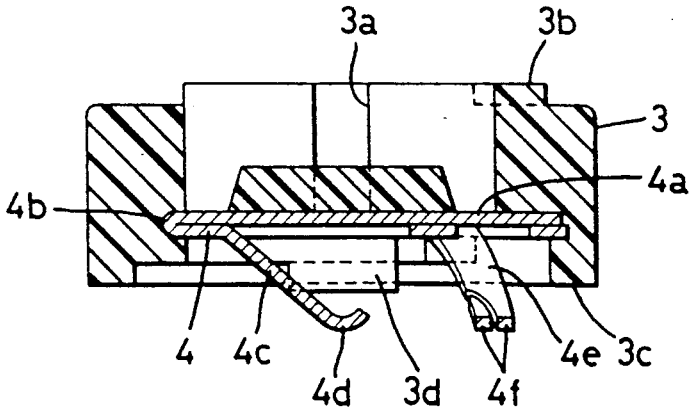
Figure 9:
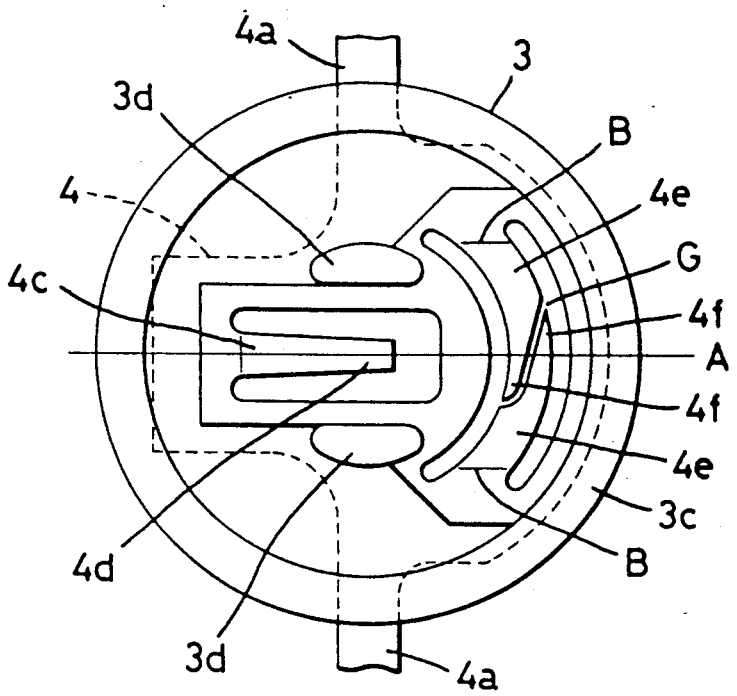

A cross-shaped drive-engaging groove 3*a* is formed at the upper surface of the rotor 3, as shown in FIG. 7 through FIG. 9. At the lower side of the rotor 3 is formed the annular skirt portion 3*c* adjacent the elastic body 8 on the substrate I (see FIG. 13). Also, the substrate portion 4*a* of the sliding member 4 is secured integrally by molding to a lower portion of the rotor 3. Projections 3*d*, 3*d* are provided at the bottom surface of the rotor 3 in such a manner as to abut against the substrate 1 when the rotor 3 is rotated by the driver to adjust resistance value, thus preventing damage to the rotor 3 as well as deformation of the sliding member 4 due to additional pressure. Thermosetting resin or thermoplastic resin superior in heat resistance, such as PPS resin or the like, may preferably be used for the rotor 3 so as to inhibit deformation and other heat induced characteristics caused by heat used in the bending process of the ring-shaped projection 2*b* of the resin case 2.

The sliding member 4, formed by a pressing process performed on a sheet of conductive metal plate, comprises the substrate portion 4*a*, the contact portion 4*d* positioned at substantially the center thereof and at the end of the arm portion 4*c*, and the contact portions 4*f*, 4*f* at the ends of a pair of arms 4*e*, 4*e*, as shown in FIGS. 8 through 11.

The substrate portion 4*a* is bent at the end portion 4*b* to obtain a folded construction. The arms 4*e*, 4*e* extending in the peripheral direction are cut, for example, along a curved line, consisting of a straight line and a circular arc, so as to be divided into two, inner and outer, peripheral parts so as to form the contact portions 4*f*, 4*f*. In addition, arms 4*e*, 4*e* are bent toward the substrate 1 side along the straight lines B, B which are parallel to straight line A linking the center of the substrate 4*a* and the contacts 4*f*, 4*f*, with the end portions thereof being bent in the opposite direction to form the contacts 4*f*, 4*f*. In this case, when brought operatively into contact with the resistor 6 after all bending processes have been completed, the contacts 4*f*, 4*f* are positioned on the straight line A.

Figure 10:
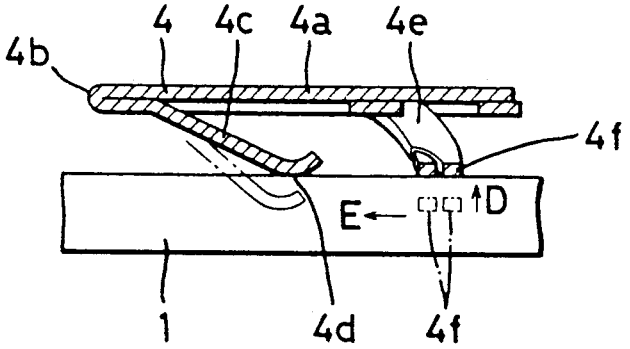

When not in contact, the contact portions 4*f*, 4*f* are in the position of the chain line in FIGS. 10 and 11, while, when mounted on the substrate 1, they are bent in the D direction and shift to the position shown by a solid line. In the present example, the arms 4*e*, 4*e* are bent at the lines B, B, which are parallel to the line A, to move the contact portions 4*f*, 4*f* vertically in the D direction. If the arms 4*e*, 4*e* are bent at an angle with respect to the line A, the contacts 4*f*, 4*f*, when out of contact with the resistor, would have to be in a position more toward the arrow E direction than that of a chain line, in order to place the contacts 4*f*, 4*f* in the position shown in a solid line when mounted on the substrate 1. When molded, the rotor 3 houses the contact portions 4*f*, 4*f* and arms 4*e*, 4*e* in the cavity of a metal mold (not shown). If the contacts 4*f*, 4*f* are out of contact and shifted more toward the E direction than as shown by chain lines, the contacts 4*f*, 4*f* as well as arms 4*e*, 4*e* cannot be housed in this manner. In the present example, the arms 4*e*, 4*e* are bent at the lines B, B which are parallel to the line A to move the contact portions 4*f*, 4*f* vertically in the D direction, thus allowing the rotor 3 to be molded in the manner described above.

In addition, in the present example, the contact portions 4*f*, 4*f* are cut along, for example, two substantially circular arcs, or a straight line and at least one substantially circular arc, and then the arms 4*e*, 4*e* are bent at the line B, so that gap G is formed between the contact portions 4*f*, 4*f*, thereby preventing mutual interference therebetween from occurring and improving contact reliability of the contact portions 4*f*, 4*f* along the resistor 6. Moreover, the width of the contact portions 4*f*, 4*f* can be enlarged and processing accuracy improved. It is also a feature of this example that the arm 4*c*, having the contact portion 4*d* at the end thereof, is projected so as to be positioned at substantially the center of the substrate portion 4*a*.

When the sliding member 4 constructed as above is incorporated into the resin case 2 together with the rotor 3, the contact portion 4*d* contacts the collector electrode 7 and the contacts 4*f*, 4*f* contact the resistor 6, respectively, whereby the resistance values between the terminals 9 and 11, and 10 and 11 are adjusted according to rotational angle of the rotor 3.

Figure 14:
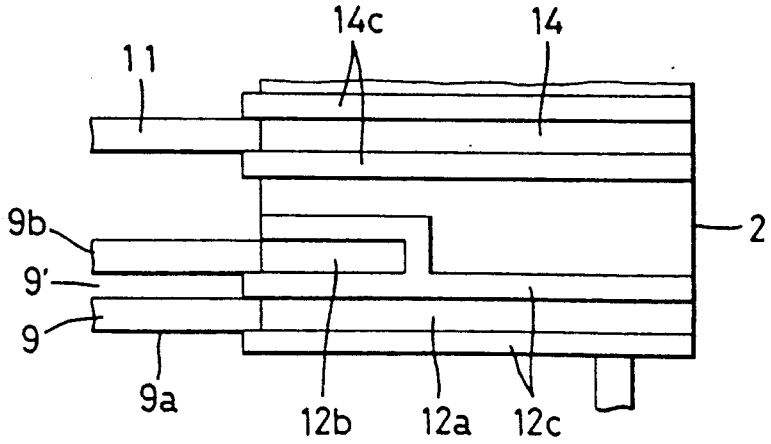

Next, assembly of this variable resistor is explained referring to FIGS. 12, 13 and 14. First, the rotor 3 is inserted into the tubular part 2*a* of the resin case 2 after the tie bars 31*a* of the sliding member 4 have been cut off. Then, the ring-shaped projection 2*b* of the resin case 2 is bent by heating it so as to prevent the rotor 3 from coming out of the resin case 2. This bending process is applied by heat bonding, a supersonic process or the like in a manner to ensure that the rotor 3 will be rotatably retained in the resin case 2.

A part 3c of the projection 2b is formed to project above a remainder thereof (see FIG. 5, FIG. 12 and FIG. 13) and when bent, overlies the upper surface of the rotor 3. A projection 3b is formed at the top end of the rotor 3 and abuts against said projection 2c, whereby the projection 2c functions as a stopper, upon a particular rotation of rotor 3, to limit the rotary angle of the rotor 3. The resin case 2 has a plurality of scales or indices in the form of cavities formed outside the right-angled projection 2b and adjacent to the driver-engaging groove 3a on the upper surface of the rotor 3. These scales act as indicators of the rotary angle of the rotor 3 with the groove 3a acting as a reference.

The scales 15 can be formed at the time when projections are heated and bent as in the case of the present example, but other processes may also be adopted. They can be formed as cavities, but printing (e.g. with ink) or hot stamping on the resin case 2 can also be used.

Next, the tie bars of the terminals 9, 10, 11 are cut off to obtain the variable resistor having the lead terminals 9, 10, 11 and the collector terminal 11 projecting from the resin case 2.

Figure 15:
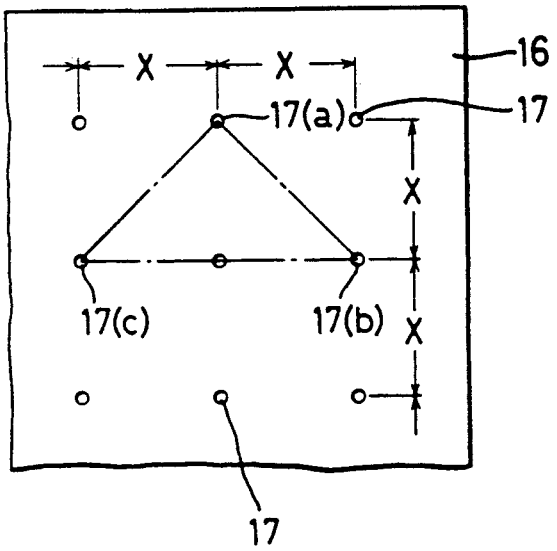
Figure 16:
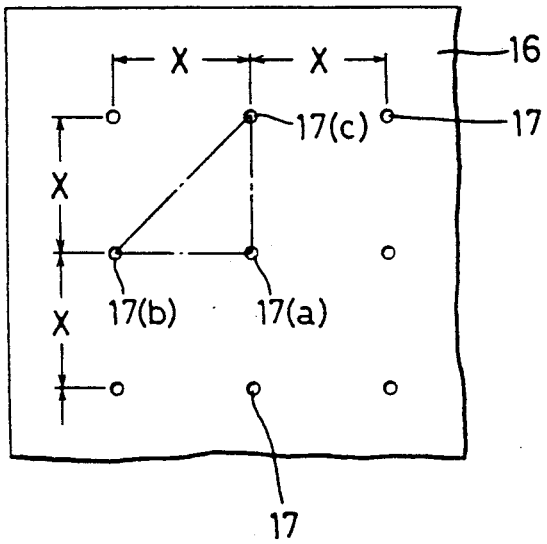

The lead terminals 9, 10 and collector terminal 11 extend along the grooves in the resin case 2, bent at suitable positions to project outside so that they are made to fit both regular and irregular pitches of 2.5 mm. A plurality of insertion holes 17 having a pitch X, 2.5 mm in this case, are formed in the printed substrate 16, as shown in FIGS. 15, 16. A regular 2.5 mm pitch defines a fixing arrangement in which the collector terminal 11 is inserted into the insertion hole 17a, and the lead terminals 9 and 10 are inserted into the holes 17b and 17c, respectively, in such a manner as to form a right-angled isosceles triangle with the base 2X and height X, as shown by a chain line in FIG. 15. An irregular 2.5 mm pitch defines a fixing arrangement in which the collector terminal 11 is inserted into the insertion hole 17a, and lead terminals 9 and 10 are inserted into the holes 17b and 17c, respectively, to form an isosceles triangle, as shown by a chain line in FIG. 16.

The above-described lead terminals 9, 10 and the collector terminal 11 can project out of not only the side surface at right angles with the groove 3a, but also from the bottom surface side of the resin case 2, in accordance with the fixing arrangements described above.

First, in projecting the terminals from the side, fitting for the regular 2.5 mm pitch (see chain line Y1 in FIG. 17) will now be explained. the collector terminal 11 projecting from the side of the resin case 2 is bent toward the bottom surface side to fit in the groove 14, and bent again at predetermined position P1, thus projecting at a right angle from the side. The tines 9b, 10b of the forked lead terminals 9, 10 are cut off and the remaining tines 9a, 10a are bent toward the upper surface, while being fit into the grooves 12a, 13a. They are bent again at the predetermined positions P2, P3 thereby projecting in parallel with the collector terminal 11. Thus, positions from which the terminals are projected are determined with respect to a right-angled isosceles triangle with the collector terminal 11 as vertex.

Next, when fitting the irregular 2.5 mm pitch (see chain line Y2 in FIG. 17), the collector terminal 11 is bent toward the upper surface of the resin case 2 to fit in the groove 14. It is again bent at the predetermined position P4 to project at a right angle with the side face. The tines 9a, 10a of the lead terminals 9, 10 are cut off, and the remaining tines 9b, 10b are bent toward the bottom surface side to fit in the grooves 12b, 13b. They are again bent at the predetermined positions P5, P6 to project in the same direction as that of the collector terminal 11, thus enabling the position from which the terminals are to be projected to be determined with respect to an isosceles triangle with the collector terminal 11 as vertex.

Figure 17:
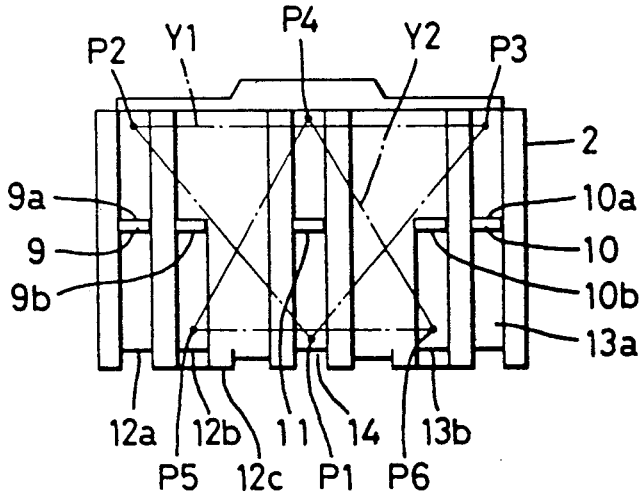
Figure 18:
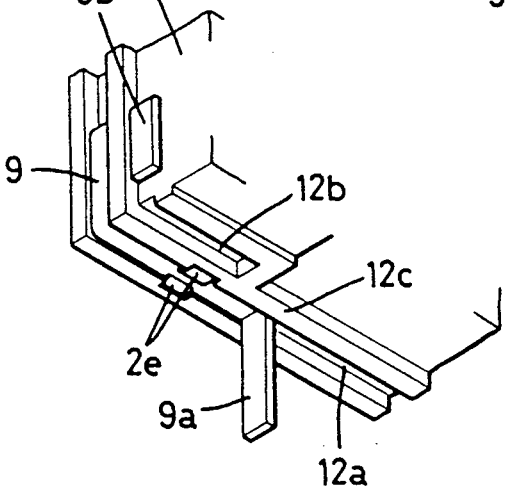

When the terminals 9, 10, 11 are projected from the bottom surface of the resin case 2, they are arranged to fit the regular and irregular pitch of 2.5 mm, as above-described, to project in such a way as to form at the bottom of the case 2 triangles Y1, Y2 as in FIG. 17. At the position from which the terminals project, for example, at the bottom side, as shown in FIG. 18, the edge portion of the groove 12a is heated and bent toward the tine 9a side, and then caulked, to secure the tine 9a such that it does not disengage from the groove.

Figure 19:
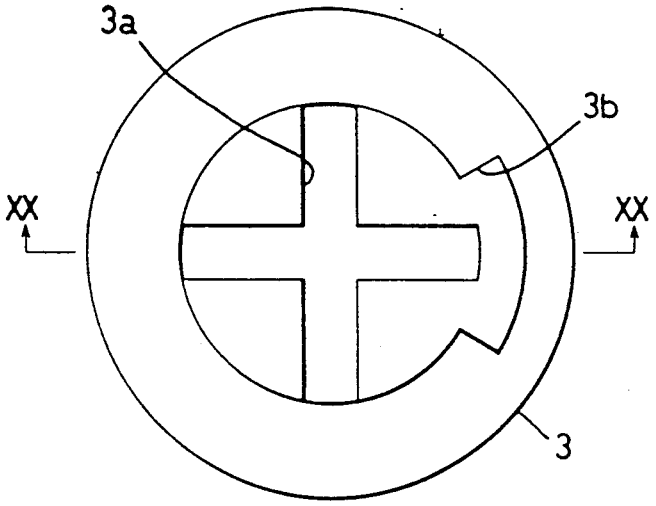
FIG. 19 through FIG. 21 show a second example of the variable resistor of the invention.
Figure 20:
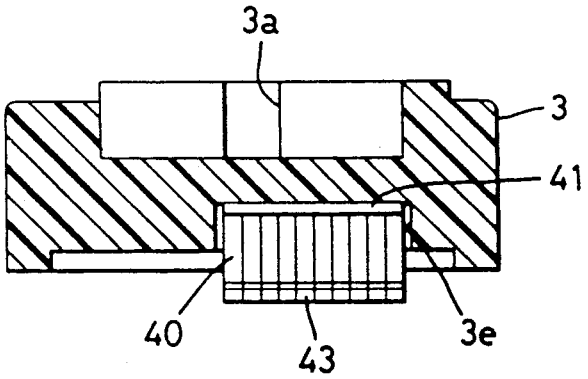
Figure 21:
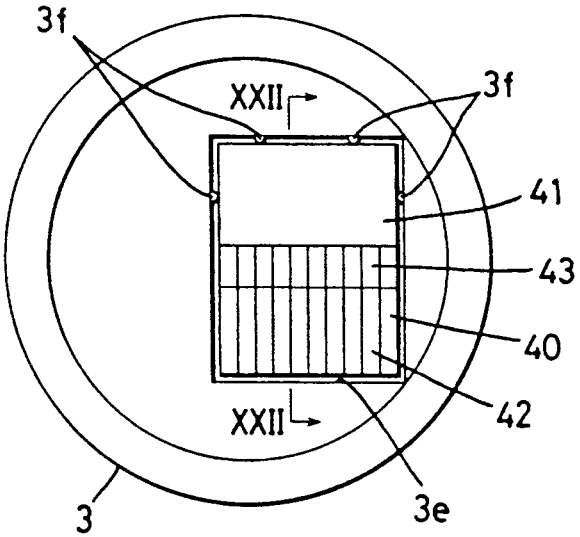
Figure 22:
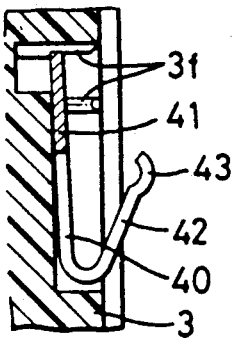
FIG. 22 is a sectional view of FIG. 21 taken along the XXII—XXII thereof.
Figure 23:
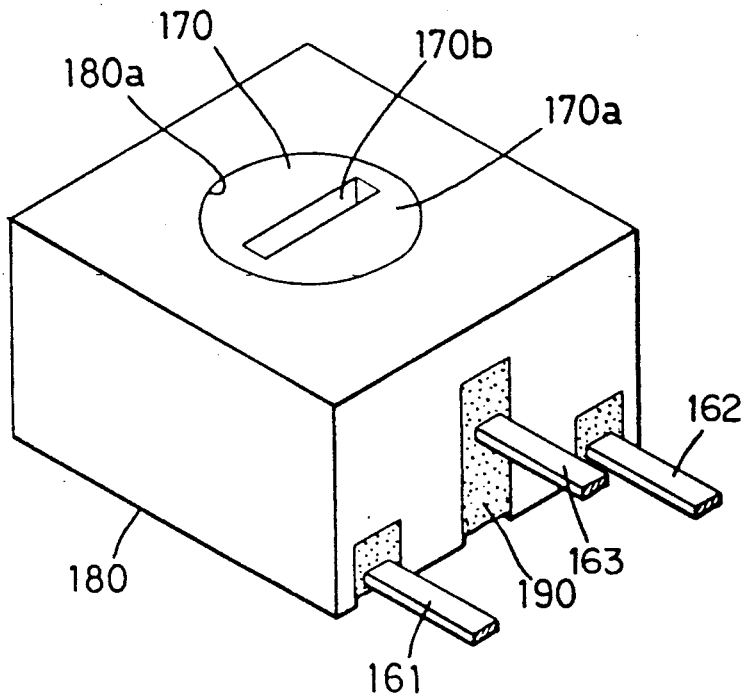
FIG. 23 (PRIOR ART)
FIG. 23 is a perspective view of a conventional variable resistor.
Figure 24:
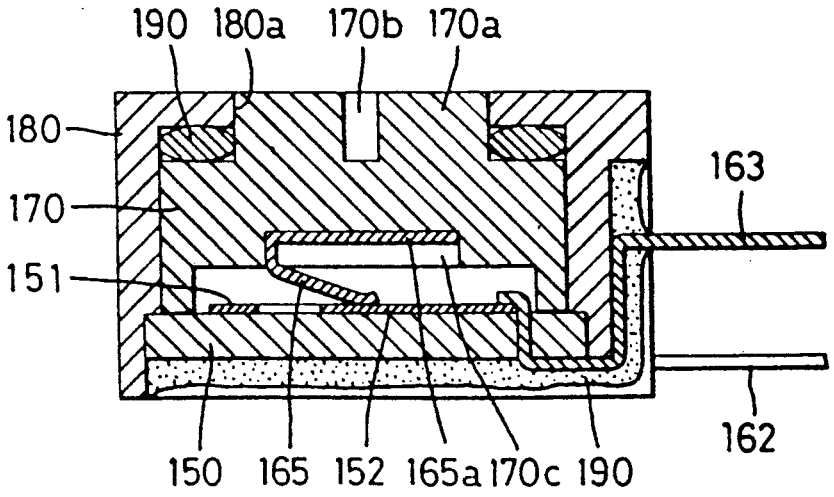
FIG. 24 (PRIOR ART)
FIG. 24 is a vertical section of the conventional variable resistor.
Figure 25:
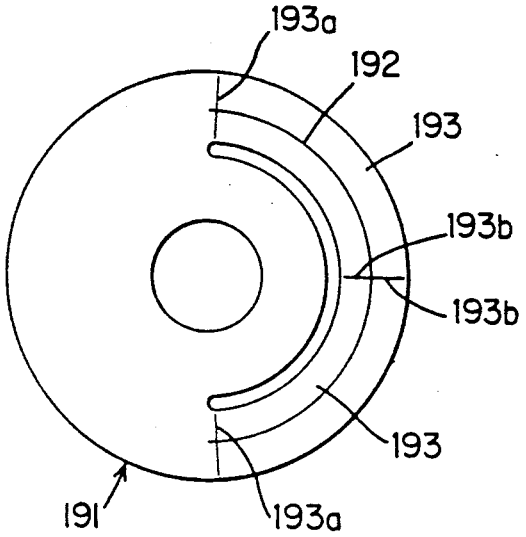
FIG. 25 (PRIOR ART)
FIG. 25 is a plan view showing another example of a sliding member used for a conventional variable resistor.
Figure 26:
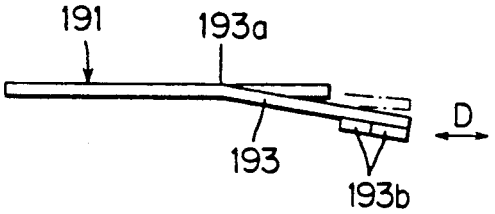
FIG. 26 (PRIOR ART)
FIG. 26 is a front view of FIG. 25.
Figure 27:
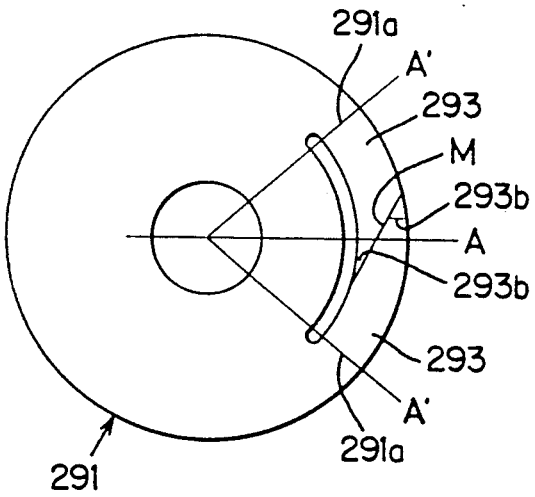
FIGS. 27 and 28 are plan views of two types of sliding members.
Figure 28:
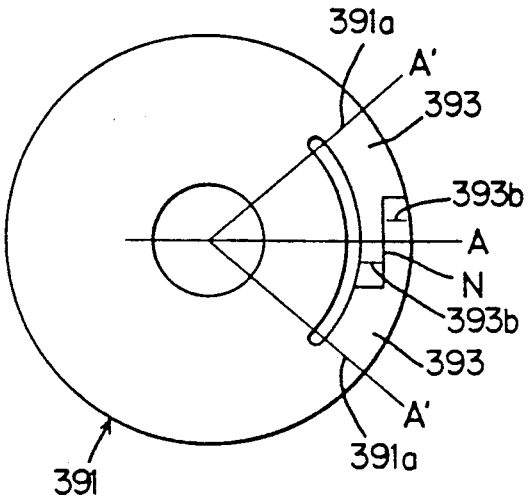

Next, the second example in FIGS. 19 through 21 shows the sliding member 40 fixed in the concave recess 3e formed at the bottom surface of the rotor 3. The sliding member 40 is constructed basically in the same way as that of the conventional one shown in FIG. 24. A plurality of brush-shaped arms 42 are bent from the substrate portion 41 to make the end portions thereof the contacts 43. The substrate portion 41 of the sliding member 40 is forced to fit between a plurality of projections 3f provided at the side wall in the concave recess 3e so as to be integral with the rotor 3.

Except for the above-noted differences, the second example of the variable resistor is constructed in the same way as the first one.

Though the invention has been explained in detail with reference to the examples, it is not limited to the content described above. Needless to say, changes can be made within the scope of the invention. For example, the elastic body 8 may be secured to the lower surface of the skirt portion 3c of the rotor 3. Also, cream solder may be used to fix the terminals 9, 10, 11 to the electrodes 6a, 6b, 7. And, the terminals 9, 10, 11 may be bent toward the grooves 12a, 12b, 13b, 14 in a reverse direction compared with the arrangements shown in FIG. 17.

I claim:

1. A variable resistor comprising:

a unitarily molded resin case including a bottom wall and a tubular side wall extending upwardly from said bottom wall so as to define a space within said case;

an insulating substrate molded into said space within said case;

a resistor and a collector electrode mounted on a surface of said insulating substrate, said resistor having opposing ends;

a collector terminal connected to said insulating substrate in electrical contact with said collector electrode and projecting outwardly of said case from said space within said case;

a pair of lead terminals connected to said insulating substrate in electrical contact with said opposing ends of said resistor, respectively, and projecting outwardly of said case from said space within said case;

a rotor rotatably mounted above said insulating substrate for rotation about a rotary axis within said space in said case; and an electrically conductive sliding member fixed to a lower portion of said rotor so as to be rotatable therewith relative to said insulating substrate and in contact with said resistor;

wherein an upper peripheral projecting edge of said tubular sidewall is bent downwardly so as to overlie said rotor and rotatably retain said rotor within said space in said case.

2. A variable resistor as recited in claim 1, wherein said rotor includes a downwardly extending portion; and an annular elastic body is mounted between said insulating substrate and a bottom surface of said skirt portion.

3. A variable resistor as recited in claim 1, wherein said sliding member is molded into said rotor.

4. A variable resistor as recited in claim 3, wherein said sliding member is formed of a metal plate cut and bent so as to comprise a substrate portion, a downwardly bent arm portion for electrically contacting said collector electrode, and a pair of downwardly bent arms with contact portions at ends thereof, respectively, for slidably electrically contacting said resistor.

5. A variable resistor as recited in claim 4, wherein said pair of downwardly bent arms are bent downwardly from said substrate portion of said sliding member along lines which are parallel to a diametric line through the rotary axis of said rotor.

6. A variable resistor as recited in claim 1, wherein each of said pair of lead terminals is formed with a plurality of elongated tines.

7. A variable resistor as recited in claim 6, wherein at least one of said plurality of tines is cut from each of said lead terminals.

8. A variable resistor as recited in claim 1, wherein said upper peripheral projecting edge of said tubular sidewall is bent downwardly by heating.

9. A variable resistor as recited in claim 1, wherein said tubular side wall of said case includes a peripheral portion located radially outwardly of said upper peripheral projecting edge; and indices are provided on said peripheral portion.

10. A variable resistor as recited in claim 1, wherein said upper peripheral projecting edge of said tubular sidewall includes a projecting portion which, prior to said projecting edge being bent downwardly, projects above a remainder of said projecting edge, and which, subsequent to said projecting edge being bent downwardly, projects radially inwardly further than the remainder of said projecting edge.

11. A variable resistor as recited in claim 1, wherein said resistor and said collector electrode are mounted on an upper surface of fluid insulating substrate.

12. A variable resistor as recited in claim 1, wherein said collector terminal and said pair of lead terminals are positively fixed to said insulating substrate in electrical contact with said collector electrode and said opposing ends of said resistor, respectively.

13. A variable resistor as recited in claim 1, wherein said collector terminal and said pair of lead terminals are fixed to said insulating substrate prior to said insulating substrate being molded into said space within said case.

14. A variable resistor as recited in claim 1, wherein said electrically conductive sliding member is molded into said rotor.

* * * * *